United States Patent [19]

Brady

[11] 4,128,345

[45] Dec. 5, 1978

[54] FLUID IMPULSE MATRIX PRINTER

[75] Inventor: John F. Brady, Clifton, N.J.

[73] Assignee: Universal Technology, Inc., Clifton, N.J.

[21] Appl. No.: 665,794

[22] Filed: Mar. 11, 1976

Related U.S. Application Data

[63] Continuation-in-part of Ser. No. 563,058, Mar. 28, 1975, abandoned.

[51] Int. Cl.[2] ..... B41J 3/04; B41J 3/20

[52] U.S. Cl. ..... 400/120; 101/93.10; 346/75; 346/76 R; 400/121; 400/176

[58] Field of Search ..... 346/1, 75, 76; 178/5, 178/94; 197/1 R, 15; 101/1, 93.10, 114, 401.2, 426

[56] References Cited

U.S. PATENT DOCUMENTS

| | | | |
|---|---|---|---|
| 1,770,493 | 7/1930 | Ranger | 346/1 |
| 3,034,628 | 5/1962 | Wadey | 197/15 |
| 3,063,050 | 11/1962 | Millis | 346/75 X |
| 3,152,858 | 10/1964 | Wadey | 346/75 |
| 3,217,640 | 11/1965 | Bradshaw | 197/1 R X |
| 3,545,374 | 12/1970 | Hendricks | 101/1 |
| 3,582,954 | 6/1971 | Skala | 101/1 X |
| 3,911,818 | 10/1975 | MacIlvaine | 197/1 R X |
| 4,027,762 | 6/1977 | Nakauchi | 197/1 R |

*Primary Examiner*—Paul T. Sewell
*Attorney, Agent, or Firm*—Pennie & Edmonds

[57] ABSTRACT

A printer is disclosed for use in printing indicia or the like on a sheet of recording medium by selective application of impulses of fluid. The printer comprises a sheet support mechanism, a print head, fluid supply means, a valve assembly, and an input system. The support mechanism supports and selectively advances the sheet of recording medium. The print head includes a one- or two-dimensional array of tubes arranged to form a dot matrix for printing alphanumeric characters on the sheet. It may extend the width of the recording medium or be movable across it. Connected to these tubes are the fluid supply means and a valve assembly that includes a separate valve for each tube for controlling the supply of fluid thereto. In one embodiment of the invention, a heater raises the temperature of the fluid passing through the tubes enough that printing takes place on the recording medium whenever the fluid is ejected from the tubes. In another embodiment, a movable pin is mounted at the distal end of each tube in such a fashion that it is driven into the recording medium when a valve is opened. In still another embodiment the movable pins are also heated enough that they affect the recording medium where they are driven into it. The input system opens and closes the valves in accordance with input signals, such that the impulses of fluid applied to the tubes produce detectable visual changes on the recording medium which represent such input signals.

25 Claims, 9 Drawing Figures

FLUID IMPULSE MATRIX PRINTER

CROSS-REFERENCE TO OTHER APPLICATION

This is a continuation-in-part of Application Ser. No. 563,058 filed 3/28/75 entitled "Impulse Printer", now abandoned.

BACKGROUND OF THE INVENTION

The present invention concerns a printer especially adapted for use in recording information on a suitable recording medium through the selective application of impulses of fluid.

Pin printers are available which use solenoids to drive pins into a recording medium to form visible indicia on, for example, pressure sensitive paper. These printers, however, are only able to operate a small number of solenoids (e.g., seven) at a time because the size and weight of the solenoids make it impractical for more to be carried on the printing carriage that moves from side to side of the recording medium as printing takes place.

A similar problem is found in a non-impact printer described in U.S. Pat. No. 1,770,493 that records electrical signals by using such signals to control the application of heat to heat sensitive paper. The printing is effected by control of cold air, which emanates from the nozzle, and crosses the path of a continuous stream of hot air emanating from a second nozzle located nearby. While this unit can be moved from side to side across a recording medium, it is difficult to form an alphanumeric dot matrix using a plurality of pairs of such nozzles because a cold air nozzle must be situated adjacent each hot air nozzle. If such an arrangement could be mounted at all on a printing carriage, more than likely the horizontal and vertical size of a character printed by such a system would be much larger than that formed by, for example, a conventional typewriter. These and other disadvantages tend to foreclose any meaningful use of such a system as a compact, high speed printer which may be used like a typewriter.

SUMMARY OF THE INVENTION

The printer of the present invention comprises a sheet support machanism, a print head, fluid supply means, a valve assembly, and an input system. The support mechanism is arranged to support and selectively advance a sheet of recording medium along a first predetermined path. The print head is suitably mounted adjacent the support means and opposite the sheet carried thereby and may extend the width of the sheet or be movable across it. The print head has a one- or two-dimensional array of tubes which are arranged in a dot matrix for printing alphanumeric characters and other indicia on the sheet. The fluid supply means supplies fluid to each of the tubes in the print head under control of the valve assembly which includes a plurality of discrete electromagnetic valves one of which is associated with each of the tubes. The input system is arranged to selectively open and close the valves in accordance with input signals whereby the supply of fluid is controlled to record on the sheet indicia which represent the input signals.

In one embodiment of the invention, a heater system heats the fluid passing through the tubes enough that visible indicia are printed by heating a discrete spot on the recording medium wherever the fluid is ejected from a tube. In another embodiment, a movable pin is mounted at the distal end of each tube in such a fashion that it is driven into the recording medium upon application of pressurized fluid to the tube. In still another embodiment, the movable pins are also heated enough that they heat the recording medium where they are driven into it. In all of these embodiments, the valve assembly can be located a considerable distance from the print head thereby permitting relatively dense packing of the tubes in the print head (e.g. six or eight tubes per 100 mils). In addition, in cases where the print head is mounted on a carriage and moved across the recording medium, there is no need to mount the valve assembly on the carriage. It can be secured instead to the frame of the printer and connected to the tubes in the print head through flexible tubing, thereby greatly reducing the mass carried by the carriage while permitting the use of 5 × 7 or 7 × 9 array of tubes to print a complete pica-sized character at once.

BRIEF DESCRIPTION OF THE DRAWING

These and other objects, features and elements of the invention will be more readily apparent from the following detailed description in which.

DETAILED DESCRIPTION OF THE INVENTION

FIGS. 1 – 5 depict a printer 10 particularly adapted for use in printing indicia 12 in the form of alphanumeric characters or the like on an appropriate recording medium 14 by selective application of pulses of a heated fluid which preferably is air. Illustratively, the indicia that are printed are dots in a 5 × 7 matrix and recording medium 14 is a flexible sheet or web of coarse, porous paper, but any number of other indicia and other recording materials may also be used.

Figure 1:
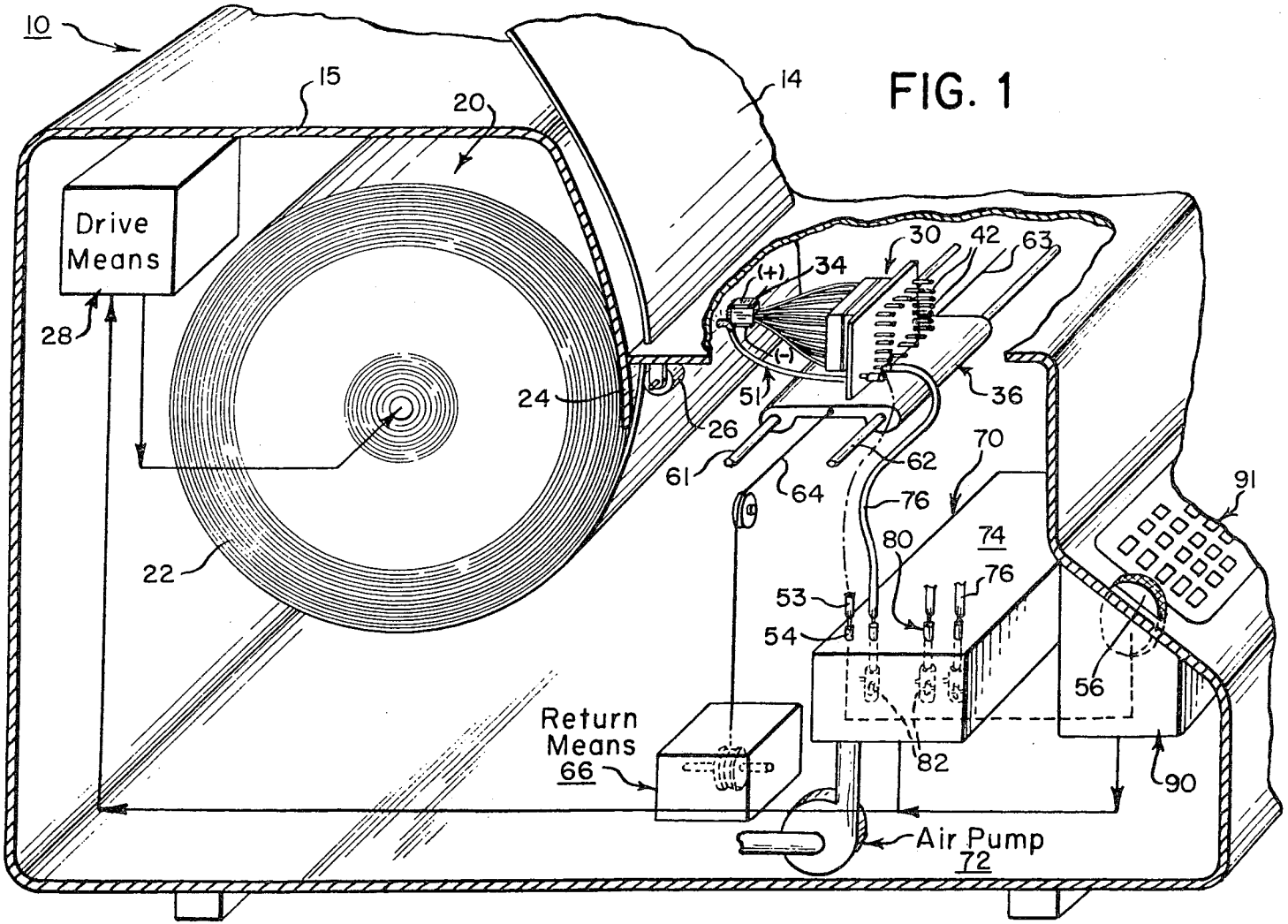
FIG. 1 is a schematic view of an illustrative embodiment of a printer made in accordance with the principles of the present invention.

In the embodiment shown in FIG. 1, the dots are formed by scorching the surface of the recording medium in responseto signals that control the application of heated air to the recording medium. To this end, printer 10 comprises a sheet support means 20, a print head 30, means 60 for moving said print head, means 70 for supplying a fluid to the print head, valve means 80 for regulating the supply of fluid, and input means 90 for controlling the valve means. As shown in FIG. 1, these elements of printer 10 are mounted in a casing 15 from which various portions have been removed to illustrate the interior of the printer. In sheet support means 20, an appropriate roll 22 of recording medium 14 is suitably journalled for rotation within the casing 15 and is so arranged that its leading edge is adapted to be selectively advanced across a platen 24. Platen 24, in this particular embodiment, is a flat backing plate which may be an extension of casing 15. Conventional spring-biased guide rollers 26 are situated at opposite ends of the recording medium 14 to hold the recording medium securely against platen 24 while simultaneously permitting recording medium 14 to be advanced selectively. An appropriate drive means generally indicated by reference numeral 28 is operatively connected to drive the roll 22 of recording medium 14 in a known manner. Since the roll drive means 28 is constructed of commercially available components, there is no need for a detailed description but it will be understood that the roll drive means 28 suitably and selectively advances the recording medium across platen 24 as print head 30 completes the printing of each line of characters on recording medium 14.

Print head 30 comprises a tube matrix 32 and a heater 34 supported on a carriage 36. As is more clearly shown in the exploded view of FIG. 3, tube matrix 32 comprises forward (leftmost in FIG. 3) and rearward mounting blocks 38, 39 in which are mounted thirty-five substantially identical discrete tubes 41, 42, respectively. Fluid is directed through these tubes (from right to left in FIG. 3) from fluid supply means 70 and out the end of the tubes, which are arranged in a closely packed $5 \times 7$ matrix to form a printing face 43. Heater 34 is mounted on the distal end of tubes 41. For convenience of assembly, tubes 41 are held together in heater 34 by a rectangular metal frame 48 that is dimensioned to pack the tubes tightly together. Heater 34 comprises upper and lower plates 45, 46 of INCONEL mounted on the top and bottom of frame 48. An electric current passed through these plates, frame 48 and the distal ends of tubes 41 rapidly heats these tubes to the desired operating temperature. In addition, a layer of reflective material (not shown) may surround heater 34 to improve its efficiency.

Tubes 41 are aligned with tubes 42 and the outside diameter of tubes 41 is smaller than the inside diameter of tubes 42 so that the portions of tubes 41 that extend beyond the rearward-facing surface of block 38 may be readily inserted into tubes 42. As a result, mounting block 38 and tubes 41 may be readily disconnected from mounting block 39 for purposes of servicing that portion of the print head or replacing it. To ensure an air-tight connection between the two sets of tubes, a rubber gasket 49 is located between mounting blocks 38, 39 and conventional means (not shown) are provided for securing mounting block 38 to mounting block 39. Mounting block 39, in turn, is secured by conventional means (not shown) to a flange 37 on carriage 36.

Tubes 41 are fabricated from a heat conductive and electrically conductive material that is also non-corrosive, for example, INCONEL. Typical inside and outside diameters of tubes 41 are 8 mils and 16 mils, respectively. Since tubes 42 do not have such a small bore and are not heated, they do not pose the same corrosion problem. Conventional stainless steel tubing found in hypodermic needles has been found satisfactory for these tubes. Advantageously, print head 30 is positioned so that print face 43 is spaced from the recording medium 14 enough that the fluid ejected from the distal end of the tube matrix tends to focus on the surface of recording medium 14, to form the sharpest visual indicia 12. By way of specific example, and not limitation, it has been determined that an advantageous spacing between the print face 43 and the recording medium 14 is approximately ⅛ of an inch for 8 mil. interior diameter tubing and air at a pressure of about 30 pounds per square inch (psi). While focusing of the fluid stream is preferred, it must be emphasized that the invention can be practiced and suitable indicia formed on the recording medium without such focusing.

Although the print head 30 is arranged to direct heated and pressurized air directly onto the recording medium 14, the print head may be situated so as to direct the pressurized and heated air upwardly to the recording medium so that the resulting alphanumeric characters may be seen as they are being printed. The print head may also include a suitable housing for covering the tube matrix and heater.

To avoid the creation of a heat sink at print face 43 which would decrease the efficiency of the print head, it is necessary to keep the print face relatively hot. By way of example, when the stream of heated fluid has a temperature of about 1,000° F., the temperature of print face 43 should not be less than about 400° F. in order to obtain an effective scorching action. The heat generated by heater 34 may be varied by any number of known methods. Other means may also be utilized to heat tubes 41. For example, a coil of resistor wire could be wrapped around the distal end of tubes 41 and embedded in an insulative ceramic material such as SAUEREISEN.

Figures 2, 3:
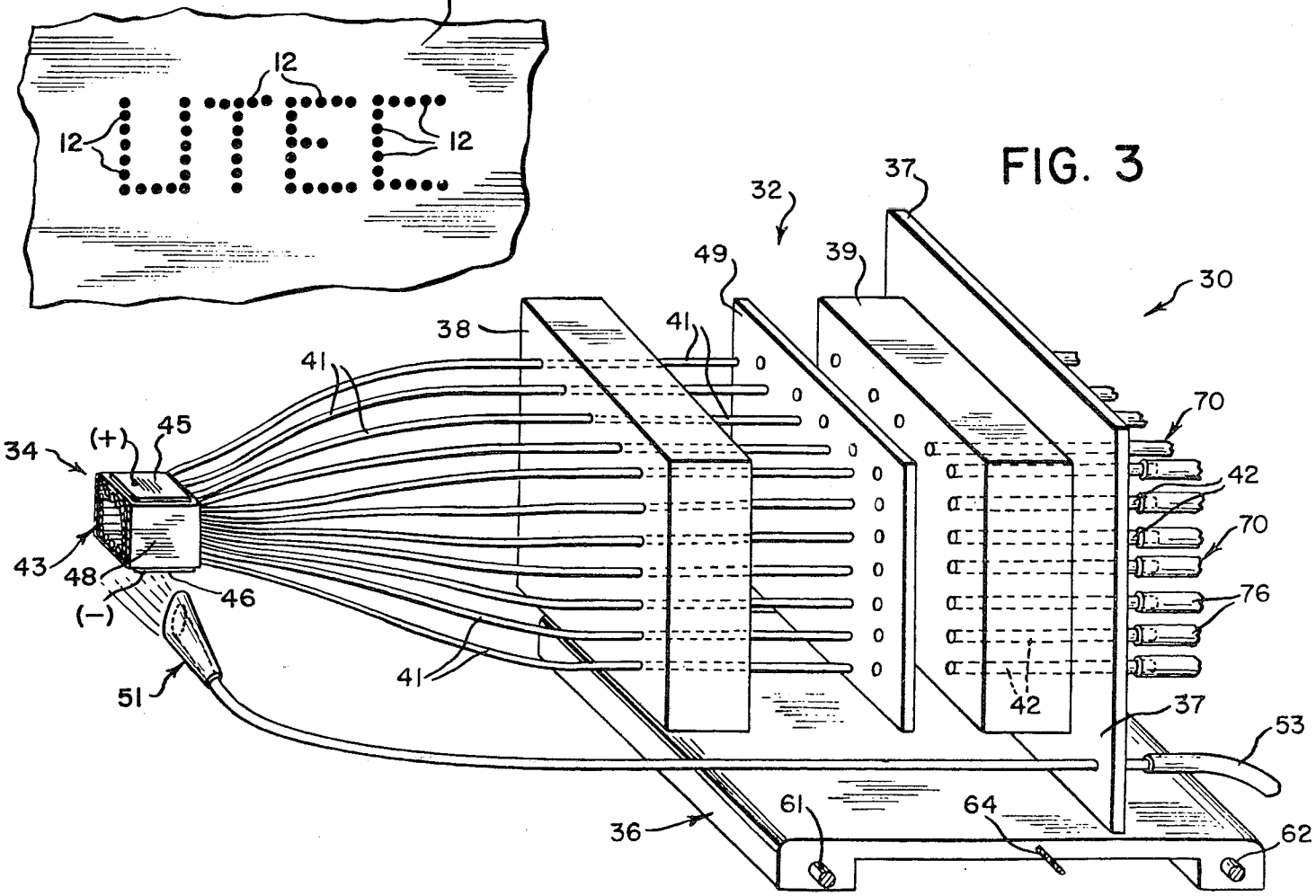
FIG. 2 is an enlarged fragmented view illustrating a recording medium with information printed thereon.
FIGS. 3 and 4 are schematic views of certain components of the embodiment of FIG. 1.
Figure 4:
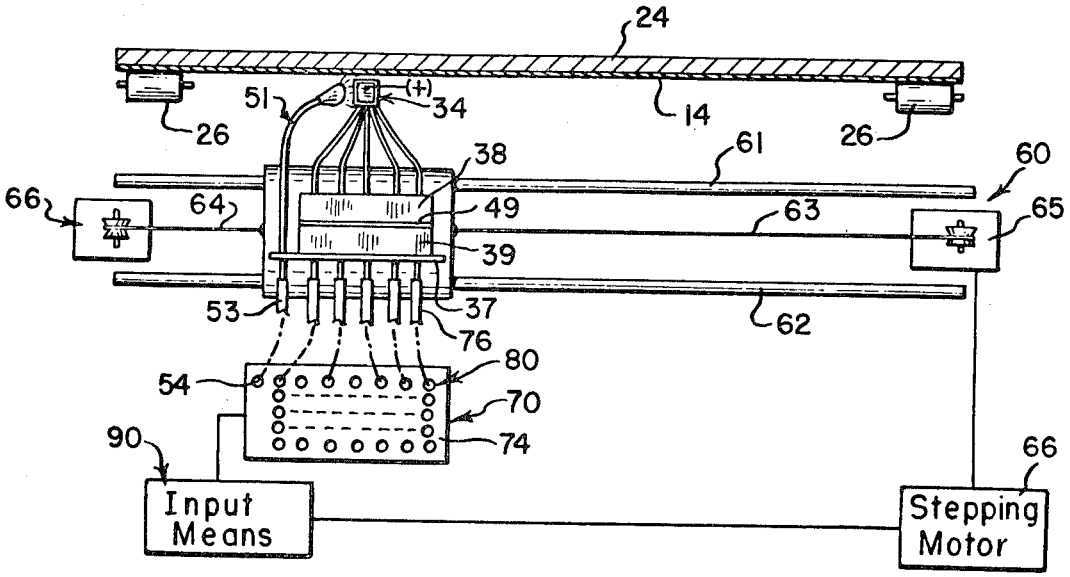

FIGS. 1, 3 and 4 also disclose a cooling means 51 which is attached to print head 30 by a suitable mounting on flange 37. Cooling means 51 includes an air tube 53 having a manual valve 54 which is operable to regulate the flow of a stream of cool air directed at the recording medium 14. This permits the operator to vary the opacity of the dots scorched on the recording medium and to prevent the heated print head 30 from scorching the recording medium 14 whenever the print head is stationary. To these ends as shown in FIG. 3 the cool air is directed onto the paper at a relatively wide angle to encompass the vertical dimension defined by the print tubes 41 in print face 43. Cooling means 51 is connected to the print head 30 so that the print head leads the cooling means 51 as the former is selectively advanced across the recording means. Thus, the recording medium is cooled only after printing occurs. Advantageously, manual valve 54 may be adjusted to vary the flow of cool air by a conventional thumb wheel 56 mounted on casing 15 and a suitable mechanical linkage between the thumb wheel and the valve. Preferably, an electromagnetic valve (not shown) is connected in series with valve 54 and is operated in synchronism with the printing so that cool air is not exhausted from tube 53 when printing is taking place.

Conventional means 60 are shown in FIG. 4 for moving print head 30 across the recording medium in the same fashion as the character element of many typewriters is presently stepped from side to side of a sheet of paper. The apparatus comprises a pair of rails 61, 62 for supporting print head 30, a cable 63 for advancing the print head in one direction and a return cable 64 for moving the print head in the opposite direction. Cable 63 may be actuated by any number of conventional means. Illustratively, it is wound on an appropriate axle in drive box 65 in response to motive power from stepping motor 66. In order to print pica-sized characters, print head 30 is moved approximately 100 mils between the printing of each character, but it has been found advantageous to make this movement in four steps of 25 mils each. Return cable 54 is connected to a conventional return means 66 which typically is some form of spring loaded device. Operation of the stepping motor advances print head 30 from left to right across the recording medium against the bias provided by the return means. A conventional latch in drive box 65 prevents the return of the print head as it is being stepped from left to right. When the print head reaches the right hand side of the recording medium, or the end of message for that particular line, actuation of a carriage return key releases the latch means in the drive box permitting the return of print head 30 to the left hand side of the recording medium. Simultaneously, actuation of the carriage return key causes drive means 28 to advance the recording medium one line of print, which in the case of pica-sized type is approximately 160 mils.

As indicated in FIG. 1, fluid supply means 70 comprises a pump 72, pressure tank 74 and conduits 76. Pump 72 supplies, for example, pressurized air on the order of about 30 psi a space, to tank 74. Mounted in the top of the tank is valve means 80 which comprises a plurality of identical valves 82 which correspond in number to the tubes 41, 42 in print head 30. A like number of conduits 76 interconnect each of valves 82 with a respective one of tubes 42 in print head 30. Conduits 76 are fabricated from flexible material to facilitate the reciprocal movement of print head 30 in the manner indicated above. Typically, the interior diameter of these tubes is approximately one-thirty-secondth of an inch (1/32 inch) and the length of each tube is approximately one foot.

Figure 9:
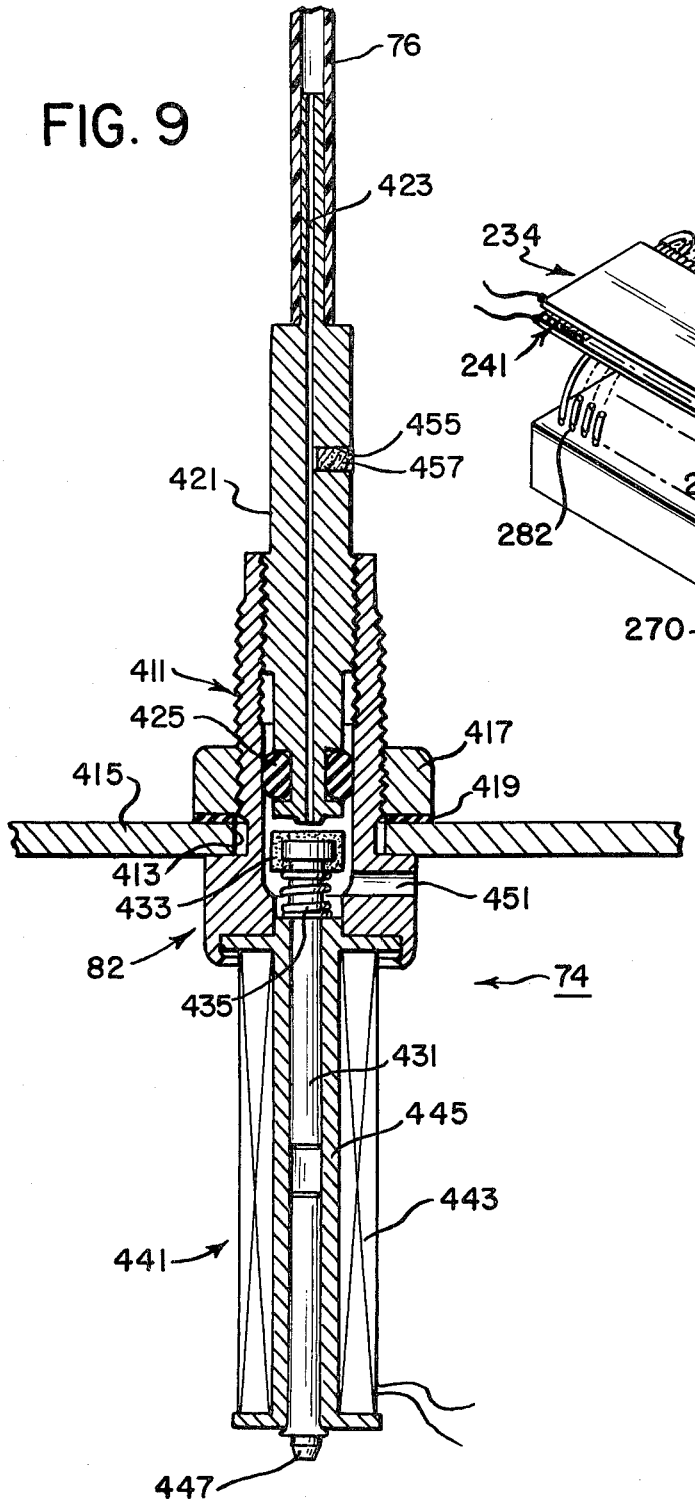
FIG. 9 is a cross-sectional view of a component of the embodiments of FIGS. 1, 6 and 7.

Each valve 82 is a small electromagnetic valve which controls the flow of fluid from the tank into the conduit in response to input signals from input means 90. An illustrative example of a valve 82 is shown in FIG. 9. The valve comprises a housing 411 which is fitted through a hole 413 in the top 415 of tank 74. A nut 417 is threaded onto the housing to secure it to the top of the tank. This nut bears on a gasket 419 which provides an airtight seal between the nut and tank top 415. A valve seat 421 is threaded within housing 411. Through the center of this valve seat runs a duct 423. The valve seat is sealed by an O-ring 425.

An armature 431 bearing a seal 433 is normally biased by a spring 435 against an open end of duct 423 to seal it shut. The armature may be opened by the action of an electromagnet 441 comprising a coil of wire 443 wound on a bobbin 445 having a core 447. Thus, each valve 82 may be selectively opened by electromagnetic action to enable fluid from tank 74 to flow through inlet 451 and duct 423, through conduit 76 and tubes 41, 42, to recording medium 14. Upon deenergization, the valve springs closed to prevent fluid flow to print head 30. Preferably, valves 82 will open and close in 15 to 30 milliseconds so as to emit short pulses of fluid with, of course, sufficient thermal energy for scorching the recording medium.

The dimensions of the elements in the fluid path from tank 74 to the recording medium are important in providing optimum performance of the invention. In practicing my invention using a heater made of a coil of resistor wire embedded in SAUEREISEN, I have found that the air it takes to print one spot requires approximately 120 times the volume of air in the heated section of the 8 mil tubing. This makes the system truly dynamic and eliminates the necessity for heat storage of air. While the invention is by no means limited to a system having this capacity since heat transfer will vary with the type of heater used and its operating temperature, enough air will always be heated to permit continuous high speed printing.

The use of very small interior diameter tubes 41 would require considerably greater air pressure were it not for the fact that conduits 76 have relatively large interior diameters. Accordingly, another important feature of my design of the conduit between tank 74 and the recording medium is the use of a relatively large diameter conduit compared with the diameter of the tubes in the print head. In general it should be found that the use of any conduit having an interior diameter larger than that of tubes 41 will reduce the power requirements needed to operate the printer with adequate control.

Still another feature of this conduit system is the use of a relief valve 455. I have found that without such a valve, hot air tends to leak out the open end of tubes 41 after valve 82 is closed. This tends to smear the dot that is scorched on the recording medium or produces a halo effect. To prevent such smearing, relief valve 455 bleeds air at a faster rate when valve 82 is closed than air would otherwise bleed out the open end of tube 41. However, when valve 82 is open the amount of air bled through relief valve 455 is considerably less than that forced out the open end of tube 41. Illustratively, relief valve 455 contains a porous plug 457 having sufficient porosity to bleed air at the desired rate. Alternatively, the relief valve could be a duct that is closed when valve 82 is opened and is opened when valve 82 is closed. Advantageously, control means can be provided to seal the relief valve shut when it is desired to print the dots with some smearing. This is helpful in making the printed dots run together, for example, in printing continuous lines and the like. I prefer to make the relief valve part of each valve 82. However, it could be formed in conduit 76 or tubes 41, 42.

Figure 5:
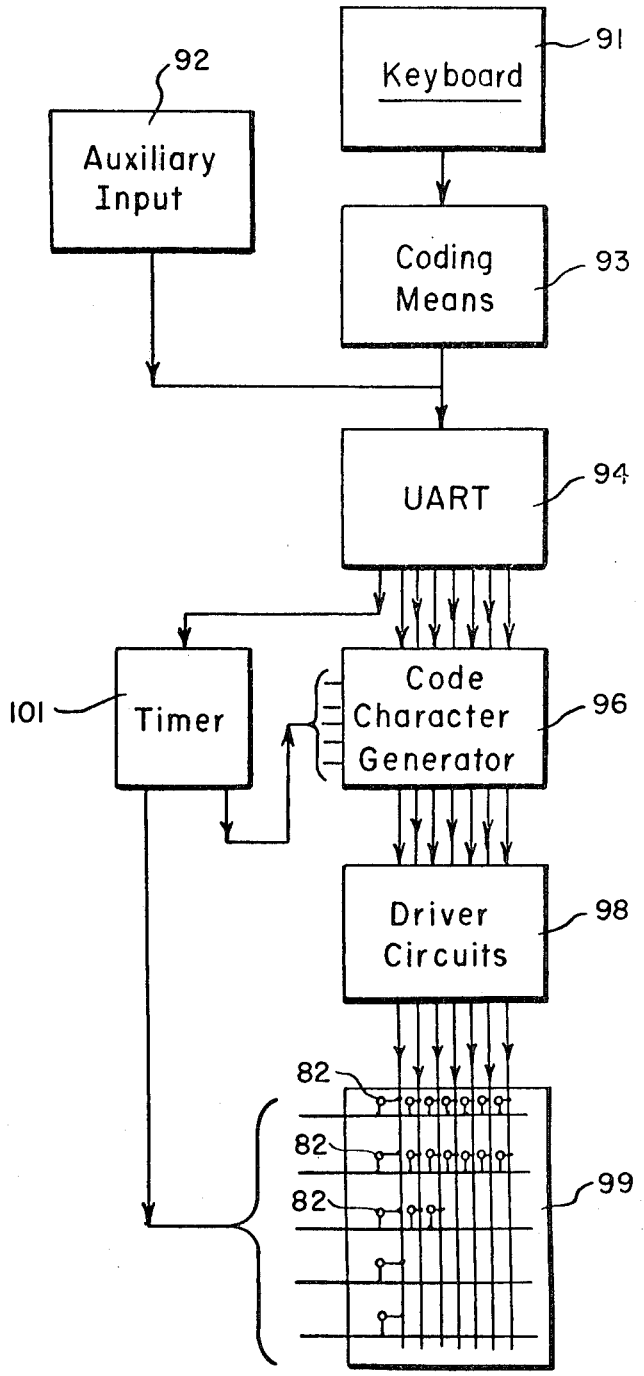
FIG. 5 is a block diagram of an electronic system for operating the embodiment of FIG. 1.

Input means 90 is more clearly depicted, in block diagram form, in FIG. 5. It comprises a keyboard 91 and the logic circuitry necessary to produce the signals that cause the printing means to form images of alphanumeric characters on recording medium 14. The keyboard could be an integral part of the printer as shown in FIG. 1; or it could be connected to the printer by a communications line. Input means 90 could also be a computer, connected to the printer either directly or by a communications line. These alternatives are symbolized by auxiliary input means 92 of FIG. 5.

In addition to keyboard 91, input means 90 comprises means 93 for coding a signal from each key of the keyboard into an 8-bit serial code, a Universal Asynchronous Receiver/Transmitter (UART) 94 for converting the serial code into a parallel code, a code character generator 96 for converting the coded parallel output from UART 94 into a coded parallel 5-bit output sequence on each of seven output lines 97, and valve driver circuits 98. These seven output lines are time multiplexed in a control matrix 99 to control the thirty-five valves 82 so as to form on recording medium 14 a pattern of dark spots in five columns and seven rows corresponding to the particular keyboard key from which the signal originated.

Keyboard 91, coding means 93 and UART 94 are conventional devices available in many commercial teletypewriter terminals such as the model 5001 Alphanumeric Keyboard with parallel output sold by Universal Technology, Inc. of Verona, New Jersey. Alternatively, the keyboard that is used might be one that automatically generates a parallel code. Code character generator 96 is also readily available. For example, any number of programmable read only memories (PROM) are commercially available that may be programmed to convert a parallel input into a 5-bit output sequence on each of seven output lines. Advantageously, character generator 96 is programmed to accept more than one of the standard signal codes such as ASCII and BAUDOT that are used in the industry so that the same character generator can be used no matter what signal code the customer selects. Fixed format character generators are also available such as Texas Instruments' series character generator model TMS 4100 described in *The Integrated Circuits Catalog for Design Engineers,* (1st Ed., Texas Instruments).

The seven output lines control valve driver circuits 98 which operate valves 82. To minimize components, operation of the valves is time multiplexed by matrix 99. Code character generator 96 is read out in conventional fashion by a series of five strobe signals generated by a timer 101. Initiation of such strobing is controlled by a standard signal from UART 94. In addition, timer 101 supplies a series of signals to five strobe lines in matrix 99 in synchronization with the timing of the 5-bit signal generated on each of the seven outputs from character generator 96. Thus, the signal on the first strobe line in matrix 99 coincides with the arrival at the matrix of the first bit on each of the seven output lines from driver circuits 98, the arrival of a signal on the second strobe line coincides with the arrival of the second bit and so forth.

Driver circuits 98 are designed in conventional fashion to provide sufficient current upon the coincidence of a signal on an output line and a signal on a strobe line in matrix 99 to operate the valve 82 to which the two lines are connected. Advantageously, to minimize consumption of power, sufficient power is provided initially to actuate the valve and this is then reduced by known circuits to a smaller amount which is enough to hold the valve open for the duration of time needed for the printer to form the dot associated with the valve being actuated. Since the five strobe lines are sequentially actuated, not all valves are actuated simultaneously, a feature which reduces the maximum power drain. However, to expedite printing, there is an overlap in the periods of time during which the valves actuated by different strobe lines are open. Typically, the delay between pulsing of adjacent strobe lines in matrix 99 is about two milliseconds.

Input means 90 also includes conventional means responsive to the depression of a key to produce a signal to the stepping motor 66 to advance print head 30 when the character identified by the key has been printed. In addition, the input means 90 includes conventional means responsive to the depression of the carriage return key for producing a signal to drive box 65 to release the latch and permit the return of print head 30 under control of return means 66. The signal to drive box 65 is also applied to drive means 28 to advance recording medium 14 one line.

Numerous modifications may be made in the invention. Although the invention has been described with respect to a preferred embodiment in which jets of heated air are used to singe paper, other gases and even liquids could be used instead. Moreover, it is only necessary that the heat of the fluid be instrumental in affecting the recording medium so as to produce a record of its impingement thereon. In place of ordinary paper, heat sensitive papers may be used as the recording medium. With at least some papers, indicia are recorded by a color change formed by a chemical reaction triggered by a change in temperature. Because the energy required to initiate such chemical reactions typically is less than that required to singe paper, the use of heat sensitive paper would permit lower operating temperatures and/or faster writing speeds. Records may also be formed with this invention that are not readily visible to the naked eye. For example, the recording medium could be a thermoplastic medium whose thickness is increased or decreased by the application of heat thereto or it might be a magnetic medium in which the application of heat alters the direction of magnetization in a localized area. Numerous other recording media will be apparent to those skilled in the art. For convenience the formation of indicia on these and all other recording media will be referred to below as printing and the apparatus for effecting such printing as a printer.

The print head disclosed above is only one of many configurations. Obviously, the thirty-five tubes need not be arranged in a 5 × 7 array and, if desired, many more tubes may be used. For example, a 6 × 8 array of tubes approximately 16 mils in outer diameter takes up approximately the full width of a character of pica-sized type. When printing alphanumeric characters with a 100 mil center-to-center spacing, a 5 × 7 subset of the 6 × 8 array could be used for printing purposes while the unused column in the 6 × 8 array provides the spaces between adjacent characters. Since the width of the 6 × 8 array is substantially the same as the distance the print head is moved between adjacent characters, this same 6 × 8 array can also be used to print other information continuously across the page. Thus, continuous lines, sketches and pictures can be composed using a print head having a size that substantially matches the distance it is stepped in the horizontal direction and the distance the recording medium is advanced in the vertical direction.

By increasing the number of tubes per unit dimension, the resolution of the printer can be increased. For example, a 8 × 10 array of tubes having 12 mils outer diameter would have the same horizontal dimensions as the 6 × 8 array but would have considerably greater resolution. For such an array a 7 × 9 subset would be used for printing alphanumeric characters and the remaining column for spacing between them.

The embodiment shown in FIG. 1 does not lend itself to producing a large number of multiple copies although it is possible to make more than one copy with this embodiment by printing onto sheets of very porous paper, or the second or third copies may be selectively more sensitive paper. In such a case the jet of heated air will penetrate one or more layers of porous paper, marking each one in turn. Where a large number of copies have to be made at one time, it is preferred to modify the apparatus of FIG. 1 by adding an impact device 120 between the distal end of the tubes and the recording medium as shown in cross-section in FIG. 6.

Impact device 120 comprises a matrix 122 in which are located an array of T-shaped movable elements 124 corresponding in number and position to the number and position of the tubes. Matrix 122 is located between the distal ends of tubes 141 and the recording medium 114. Tubes 141 are substantially the same as tubes 41 of the apparatus in FIG. 1; and recording medium 114 is several sheets of pressure sensitive paper. For purposes of printing, recording medium 114 rides on a platen 116 which is substantially the same as platen 24 of the embodiment shown in FIG. 1.

Figure 6:
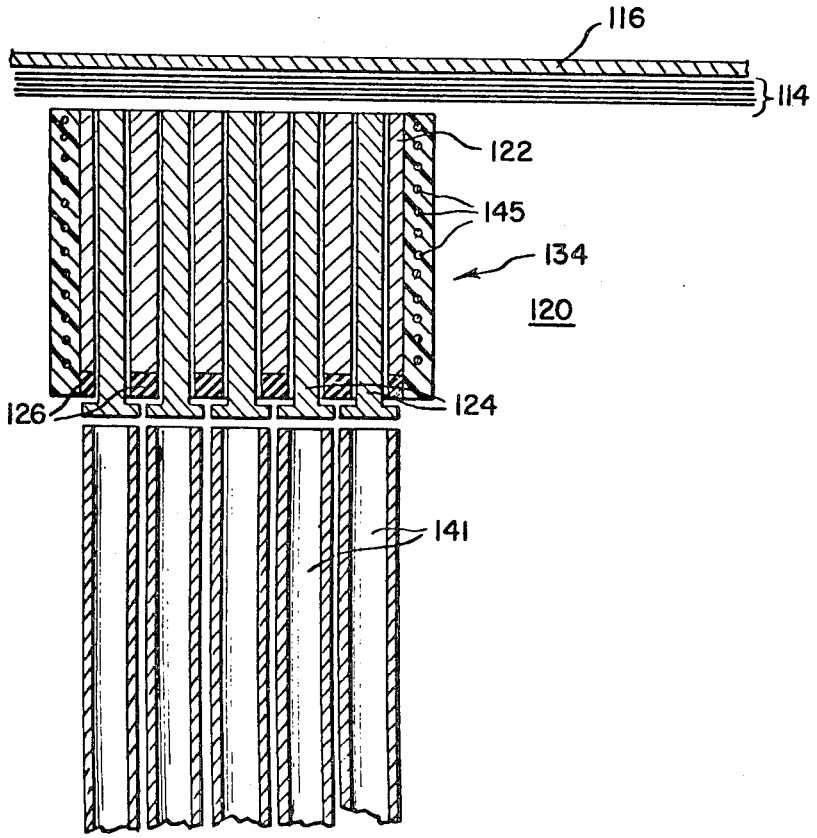
FIG. 6 is a cross-sectional view of a portion of a second illustrative embodiment of a printer made in accordance with the principles of the present invention.

As shown in the cross-section of FIG. 6, each T-shaped movable element 124 in matrix 122 is aligned with the distal end of a tube 141 so that the element is driven toward recording medium 114 when fluid emerges from that tube. The length of travel of each movable element is such as to permit the element to transfer its impression to the lowermost sheet of pressure sensitive paper. A rubber layer 126 is mounted on matrix 122 to return movable elements 124 to their initial position. The spacing between this layer and the crosspiece of each movable element is such that the crosspiece is driven into the rubber layer in the process of creating an impression on the sheets of pressure sensitive paper, thereby insuring that the movable element rebounds from layer 126 to its initial position shown in FIG. 6.

Printing on the topmost sheet of paper can be effected using a suitable pressure sensitive paper, or by using a conventional inked ribbon (not shown) between impact device 120 and the recording medium, or by selective application of heat to the recording medium in a fashion related to that used in the embodiment shown in FIG. 1. To apply heat to the recording medium, movable elements 124 are heated by a heater 134 comprising a coil of resistor wire 145 wrapped around matrix 122 and embedded in SAUEREISEN.

Figure 7:
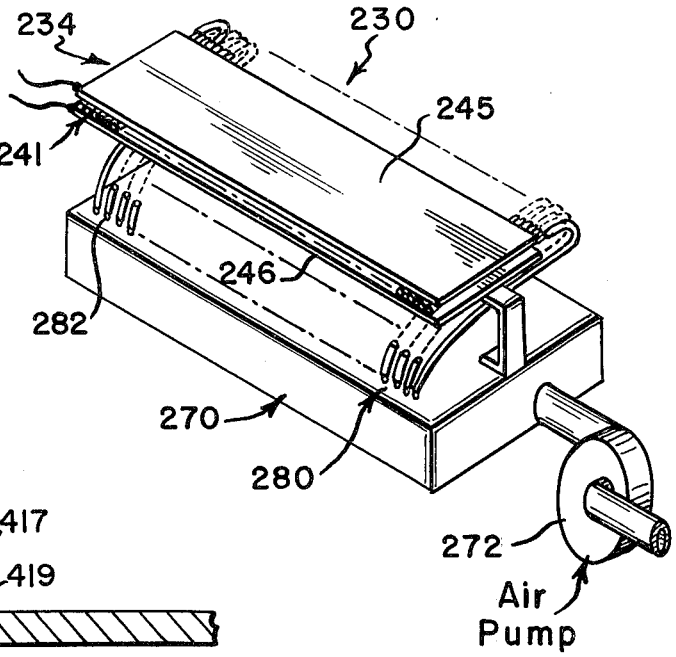
FIG. 7 is a view of a portion of a third illustrative embodiment of a printer made in accordance with the principles of the present invention.

The invention may also be practiced using a stationary printing head that extends the full width of the line to be printed as shown in FIG. 7. The apparatus there disclosed comprises a print head 230, means 270 for supplying a fluid to the print head, valve means 280 for regulating the supply of fluid and input means for 298 controlling the valve means. Print head 230 comprises an array 232 of tubes 241 similar to matrix 32 and tubes 41 but extending in an one-dimensional array the full width of the line to be printed. Thus, if an eight inch line is to be used and the outer diameter of tubes 241 is 16 mils, there are 500 tubes 241 arranged in a line in print head 230. A heater 234 surrounds the distal end of tubes 241 and, like heater 34 comprises upper and lower plates 245, 246 which heat the distal ends of tubes 241 by passing an electric current through them. Alternatively the heater could be a coil of resistor wire wound around the tubes and embedded in an insulative ceramic material such as SAUERISEN.

Tubes 241 are connected to a fluid supply means 270 that comprises a pump 272, a pressure tank 274 and conduits 276 all of which are similar to the corresponding elements in FIG. 1 with the exception that they are designed to supply fluid to 500 tubes instead of the thirty-five shown in FIG. 1. The supply of fluid from tank 274 to each of conduits 276 is regulated by valve means 280 which comprises individual valves 282 mounted on tank 274 so as to regulate the flow of fluid from the tank for each conduit. Valves 282 and their operation are similar to those described in FIGS. 1 and 9.

Figure 8:
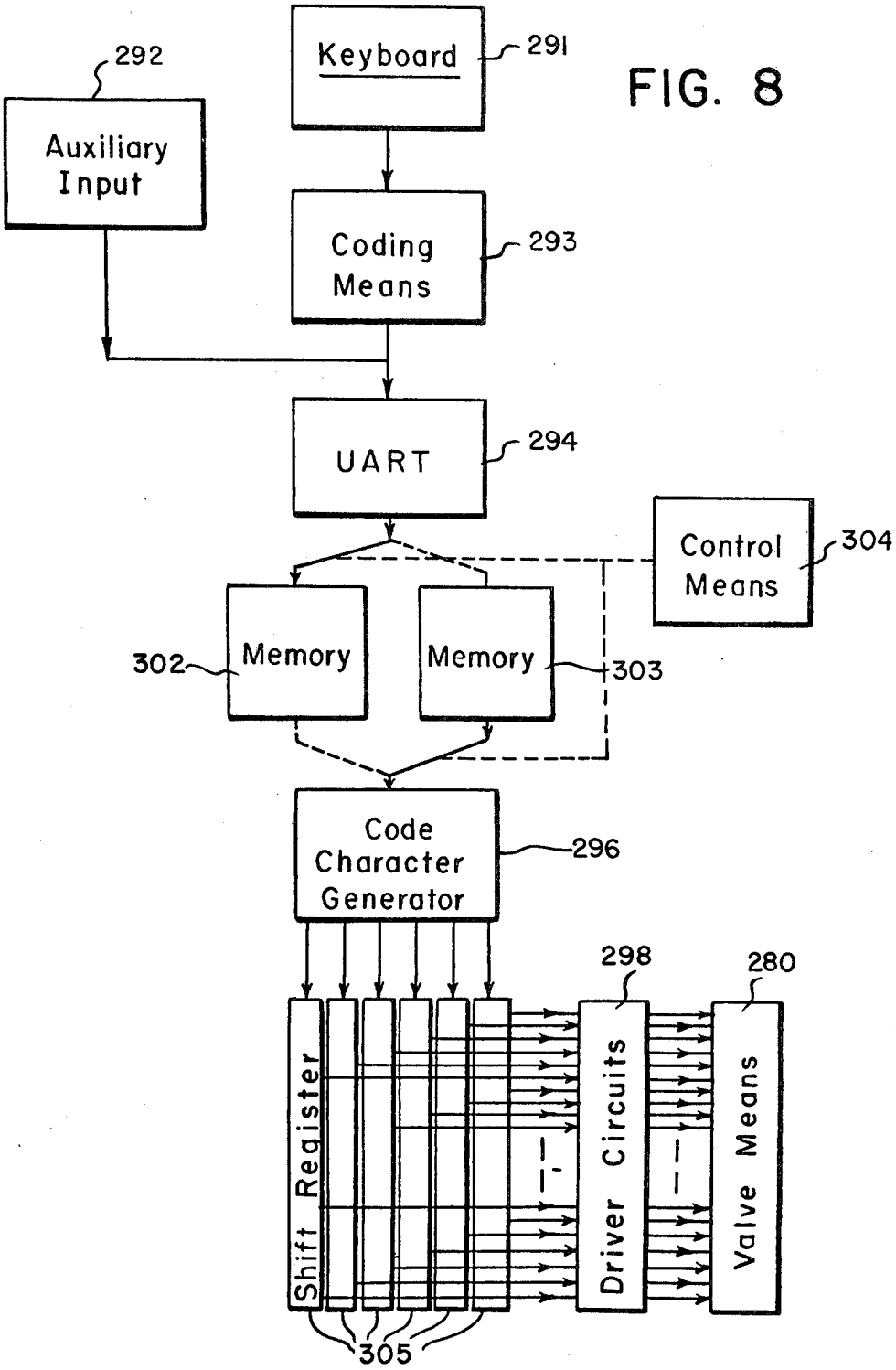
FIG. 8 is a block diagram of an electronic system for operating the embodiment of FIG. 7.

Input means for controlling valves 282 is shown in FIG. 8. It comprises a keyboard 291, optional auxiliary input 292, a coding means 293 and a UART 294, all of which are similar to the corresponding elements of FIG. 5. Thus, upon selection of a key on the keyboard a code is generated by coding means 293 and this is converted by UART 294 into a parallel output on eight lines.

Unlike the apparatus of FIGS. 1-6, the printer of FIG. 7 does not print one character at a time. Rather it prints simultaneously the first of several rows of dots representing the topmost portion of all the characters in a line, then prints the second row of dots representing the next highest portion of all the characters in the same line, and so on. Thus, it is necessary to first store all the characters in a line and then decode them to ascertain which spots in the first row are to be formed, which spots in the second row are to be formed, and so on. This sequence of storage and decoding is accomplished with the aid of a pair of read/write memories 302, 303, control means 304 for switching the output from UART 294 between these memories, a code character generator 296 similar to that of FIG. 5, a series of shift registers 305, and valve driver means 298 like that of FIG. 5. Illustratively, the characters are formed using a $6 \times 8$ dot matrix and the discussion of the operation of this circuit will concern itself with such a matrix. Modification of the circuit for other matrices will be apparent.

The signal from UART 294 is fed to one of the two read/write memories 302, 303. Illustratively, these read/write memories comprise eight $1 \times 1000$ type 2102 memories manufactured by any number of sources such as Intel annd National Semiconductor. These eight memories are connected in parallel in known fashion to store the eight-bit parallel output from UART 294. As UART 294 receives the codes associated with each key being depressed on the keyboard, it converts these codes to a parallel output and forwards it to one of memories 302, 303. Each eight-bit code received is stored in an addressable location in memory. For example, each eight-bit code may be stored and after this is done, the parallel-connected address registers of the eight type 2102 memories are then incremented by one to access the next storage space in memory.

When a complete line of characters has been entered through the keyboard and stored in one of the memories 302, 303 which for purposes of illustration is assumed to be memory 302, the operator depresses the "carriage return" key. The signal from this key is applied to control means 304 which switches the output from UART 294 from memory 302 into which writing has been taking place to memory 303. Simultaneously, control means 304 connects memory 302 to code character generator 296 and commences the read-out of this memory into the character generator. For purposes of read-out, memories 302, 303 are programmed to read from the last entry to the first, in order to facilitate left-justification of the printed line, and to recirculate the memory eight times, corresponding to the eight rows of dots that are available for each line of printing. Read-out of the memory takes place at logic speeds so that all of one memory is easily read electronically during the time it takes the other memory to be written as the operator manually depresses the keys on the keyboard.

As the codes corresponding to each character are read from memory 302, they are decoded by code character generator 296. Character generator 296 is similar to that of FIG. 1 but is designed in known manner to be read-out by strobe lines one row at a time instead of one column at a time. In addition, the timing of the strobe lines and the input to the character generator are such that during the first read-out cycle from a memory 302, 303 only the first row is read-out of the character generator before the code for the next character in the line is read into the character generator, thereby terminating further read-out. During the second read-out cycle from memory, only the second row is read-out, and so forth through all eight circulations of the memory. Character generator 296 generates an output on six output lines corresponding to the six columns of a 6 × 8 dot matrix. Five of these columns are used for conventional alphanumeric characters and the sixth is used for spacing or for the provision of continuous lines in graphic displays or the like as will be detailed below.

Each output line from character generator 296 is connected to a different 84-bit shift register 305. As character generator 296 reads the first cycle from a memory 302, 303, it generates for each character a parallel six-bit output corresponding to the top row of the character. Each of these six bits is entered in a different one of shift registers 305. When the first read-out cycle has been completed the six shift registers contain all the coding necessary to generate the first row of dots representing the topmost portion of all the characters in a line. Accordingly, when the first read-out cycle is complete, control means 304 applies the signals stored in the shift registers to valve driver means 298 which control the operation of valves 282 in the same manner as valve drivers 98 control valves 82 of FIG. 1. The shift register is then reset and character generator 296 is then ready to read in a second row of dots and so on for all eight rows.

While memory 302 is being read, data is being written into memory 303. After the line corresponding to the data read from memory 302 is printed and after the data corresponding to the next line is written into memory 303, control means 304 reverses the connections between UART 294, memories 302, 303 and character generator 296 so that the next line of data may be read from memory 303 and another line of data be written into memory 302.

As will be apparent, many modifications of the stationary print head and its electronics can be made. Of particular interest is the modification of the stationary print means to provide a facsimile receiver. Inasmuch as the resolution of conventional facsimile units is 64 or 96 bits/inch, stationary print heads of the present invention using 16 mil or 12 mil O.D. tubes are quite comparable; and, since the print head extends continuously across the page, continuous lines in graphic displays and the like can readily be printed. Since the conventional facsimile signal is the sequence of bits corresponding to the dots in the line-by-line scan, a facsimile signal need not be coded for printing by equipment such as UART 294 and code character generator 296 of FIG. 8. Rather, the signal can be applied directly to the appropriate valve drivers in order to form an array of dots on the recording medium.

The stationary print head may be used with numerous types of recording media and different tube sizes just as in the case of the apparatus of FIGS. 1–5. In addition, an impact device similar to that shown in FIG. 6 can also be used with the stationary print head where it is desirable to make a large number of multiple copies.

Numerous other modifications in the embodiments shown in FIGS. 1–9 will be apparent to those skilled in the art.

What is claimed is:

1. A printer comprising:

means for printing information on a recording medium using a dot matrix comprising an array of closely-spaced tubes open at one end, means adjacent said open end of said tubes for heating a fluid carried within the tubes of said array enough that the heat of the fluid upon emerging from said open end of said tubes produces detectable indicia on said recording medium, a plurality of conduits connecting said tubes in said printing means to a stationary housing, valves mounted in said stationary housing for selectively controlling the flow of fluid through said conduits and out the open end of said tubes, and means for operating said valves in accordance with input information to control the flow of fluid through said conduits, whereby detectable indicia are produced on said recording medium that record said input information.

2. The printer of claim 1 further comprising a keyboard and means for converting signals from said keyboard into signals for controlling said valves, whereby a pattern is produced on the recording medium corresponding to the key that is selected on said keyboard.

3. The printer of claim 1 further comprising a source of pressurized fluid and a reservoir for containing said pressurized fluid, said conduits interconnecting said reservoir with each of said tubes in the printing means.

4. The printer of claim 1 wherein means are provided in either the valves or the conduits to bleed off fluid from said conduits at a rate which is faster than that at which fluid would leak out of the open end of the tubes when the valves are closed but is slower than that at which fluid is driven out of the open end of the tubes when the valves are opened, whereby no detectable effect is produced by the heated fluid on said recording medium during the time when the valve is closed.

5. The printer of claim 4 further comprising means for closing said bleed off means when the valves are opened, whereby the effect of the heated fluid on said recording medium may be controlled.

6. The printer of claim 1 wherein the conduits have a larger interior diameter than that of the tubes in the printing means.

7. The printer of claim 1 wherein said printing means comprises:

a support means, a movable printing means mounted on said support means and comprising a two-dimensional array of closely-spaced tubes open at one end, and means for moving said printing means across said recording medium, said printing means being moved on said support means.

8. The printer of claim 7 further comprising means for directing a cooling fluid at a point on said recording medium immediately after a point at which printing is taking place and means for controlling the amount of said cooling fluid to control the magnitude of the detectable indicia produced on said recording medium by the heated fluid.

9. The printer of claim 7 wherein means are provided in either the valves or the conduits to bleed off fluid from said conduits at a rate which is faster than that at which fluid would leak out of the open end of the tubes when the valves are closed but is slower than that at which fluid is driven out of the open end of the tubes when the valves are opened, whereby no detectable effect is produced by the heated fluid on said recording medium during the time when the valve is closed.

10. The printer of claim 1 wherein the array of closely spaced tubes extends across the recording medium the full width of a line.

11. The printer of claim 1 wherein the heating means comprises:

an electrically conductive frame in which the array of tubes are mounted, and first and second electrically conductive plates connected to and on opposite sides of the frame.

12. The printer of claim 1 wherein the tubes in said printing means are approximately 16 mils in outside diameter or less and are positioned next to each other in said array.

13. The printer of claim 1 wherein the fluid that is heated is a gas.

14. The printer of claim 13 further comprising a source of pressurized fluid and a reservoir for containing said pressurized fluid, said conduits connecting said reservoir with each of said tubes in the printing means.

15. The printer of claim 13 wherein means are provided in either the valves or the conduits to bleed off fluid from said conduits at a rate which is faster than that at which fluid would leak out of the open end of the tubes when the valves are closed but is slower than that at which fluid is driven out of the open end of the tubes when the valves are opened, whereby no detectable effect is produced by the heated fluid on said recording medium during the time when the valve is closed.

16. The printer of claim 15 further comprising means for closing said bleed off means when the valves are opened, whereby the effect of the heated fluid on said recording medium may be controlled.

17. The printer of claim 13 wherein the conduits have a larger interior diameter than that of the tubes in the printing means.

18. The printer of claim 13 wherein said printing means comprises:

a support means, a movable printing means mounted on said support means and comprising a two-dimensional array of closely-spaced tubes open at one end, and means for moving said printing means across said recording medium, said printing means being moved on said support means.

19. The printer of claim 13 further comprising means for directing a cooling gas at a point on said recording medium immediately after a point at which printing is taking place and means for controlling the amount of said cooling gas to control the magnitude of the detectable indicia produced on said recording medium by the heated gas.

20. A printer comprising:

means for printing information on a recording medium using a dot matrix comprising an array of closely-spaced tubes open at one end, means for heating a fluid carried within the tubes of said array enough that the heat of the fluid upon emerging from said tubes produces detectable indicia on said recording medium, a fluid supply means comprising a plurality of conduits connecting said tubes in said printing means to a fluid intake, valve means for selectively controlling the flow of fluid from said fluid intake through said conduits and out the open-end of said tubes, means in either the valve means or the fluid supply means to bleed off fluid from said fluid supply means at a rate which is faster than that at which fluid would leak out of the open end of the tubes when the valve means are closed but is slower than that at which fluid is driven out of the open end of the tubes when the valve means are opened, whereby no detectable effect is produced by the heated fluid on said recording medium during the time when the valve is closed, means for controlling the operation of said valves in accordance with input information, whereby the fluid emerging from said tubes is controlled to produce changes on said recording medium that record said input information.

21. The printer of claim 20 further comprising means for closing said bleed off means when the valve means are opened, whereby the effect of the heated fluid on said recording medium may be controlled.

22. The printer of claim 20 wherein said printing means comprises:

a support means, a movable printing means mounted on said support means and comprising a two-dimensional array of closely-spaced tubes open at one end, and means for moving said printing means across said recording medium, said printing means being moved on said support means.

23. In a printer for printing information on a recording medium using a dot matrix comprising an array of closely-spaced tubes open at one end, a printing method comprising the steps of:

adjacent the open end of said tubes, heating a fluid carried within the tubes of said array enough that the heat of the fluid upon emerging from said open end of said tubes produces detectable indicia on said recording medium, providing a plurality of conduits connecting said tubes to a stationary housing, selectively controlling with valves mounted in said stationary housing the flow of fluid through said conduits and out the open end of said tubes, and operating said valves in accordance with input information to control the flow of fluid through said conduits, whereby detectable indicia are produced on said recording medium that record said input information.

24. The method of claim 23 wherein the fluid is air.

25. The method of claim 23 further comprising the step of moving across the surface of the recording medium a two-dimensional array of said closely-spaced tubes.

* * * * *

UNITED STATES PATENT AND TRADEMARK OFFICE

CERTIFICATE OF CORRECTION

PATENT NO. : 4,128,345

DATED : December 5, 1978

INVENTOR(S) : John F. Brady

It is certified that error appears in the above-identified patent and that said Letters Patent are hereby corrected as shown below:

In the Abstract, line 26, after "detectable" delete "visual" (last word)

Column 1, line 26, after "from" delete "the (last word) and substitute therefor --one--.

Column 4, line 68, after "cable" and before "is" delete "54" and substitute therefor --64--.

Column 5, line 20, after "30 psi" and before the comma delete "a space".

Column 9, line 35, delete "for 298" (last two words) and substitute therefor --298 for--;

line 48, delete "SAUERISEN" (last word) and substitute therefor --SAUEREISEN--.

Column 11, line 46, after "is" and before "sequence" delete "the" and substitute therefor --a--.

Signed and Sealed this

*Twenty-fourth* Day of *April 1979*

[SEAL]

*Attest:*

RUTH C. MASON
*Attesting Officer*

DONALD W. BANNER
*Commissioner of Patents and Trademarks*